US007062073B1

(12) United States Patent
Tumey et al.

(10) Patent No.: US 7,062,073 B1
(45) Date of Patent: Jun. 13, 2006

(54) ANIMATED TOY UTILIZING ARTIFICIAL INTELLIGENCE AND FACIAL IMAGE RECOGNITION

(76) Inventors: David M. Tumey, 6100 Saddle View La., Crestview, FL (US) 32536; Tianning Xu, 400 W. Bitteros Rd. #809, San Antonio, TX (US) 78216

( * ) Notice: Subject to any disclaimer, the term of this patent is extended or adjusted under 35 U.S.C. 154(b) by 0 days.

(21) Appl. No.: 09/488,390

(22) Filed: Jan. 19, 2000

Related U.S. Application Data

(60) Provisional application No. 60/116,391, filed on Jan. 19, 1999.

(51) Int. Cl.
*G06K 9/00* (2006.01)
*A63H 30/00* (2006.01)

(52) U.S. Cl. ..... 382/118; 446/175

(58) Field of Classification Search ..... 382/116–127, 382/100, 276; 446/175; 700/31
See application file for complete search history.

(56) References Cited

U.S. PATENT DOCUMENTS

| | | | |
|---|---|---|---|
| 3,745,673 | A | 7/1973 | Jimerson et al. |
| 3,795,989 | A | 3/1974 | Greenberg et al. |
| 3,805,238 | A | 4/1974 | Rothfjell |
| 4,221,927 | A | 9/1980 | Dankman et al. |
| 4,449,189 | A | 5/1984 | Feix et al. |
| 4,518,358 | A | 5/1985 | Mather |
| 4,665,640 | A | 5/1987 | Forsse et al. |
| D291,818 | S | 9/1987 | Forsse et al. |
| 4,696,653 | A | 9/1987 | McKeefery |
| 4,712,103 | A | 12/1987 | Gotanda |
| 4,712,184 | A | 12/1987 | Haugerud |
| 4,754,487 | A | 6/1988 | Newmuis |
| 4,799,171 | A | 1/1989 | Cummings |
| 4,811,408 | A | 3/1989 | Goldman |
| 4,825,050 | A | 4/1989 | Griffith et al. |
| 4,849,613 | A | 7/1989 | Eisele |
| 4,858,000 | A | 8/1989 | Lu |

(Continued)

FOREIGN PATENT DOCUMENTS

| | | |
|---|---|---|
| EP | 0247788 | 12/1987 |

(Continued)

OTHER PUBLICATIONS

Hall, Ernest L., "Computer Image Processing and Recognition," Academic Press, 1979, pp. 370-375 and 115-119.

(Continued)

*Primary Examiner*—Vikkram Bali
(74) *Attorney, Agent, or Firm*—Eric W. Cernyar, P.C.

(57) ABSTRACT

An articulated and animated toy capable of recognizing human users and selected inanimate objects and interacting therewith which includes a computer-based device having stored thereon encoded first human or human-like facial images, a video camera and video digitizer for acquiring data representative of a second human or human-like facial image, and software resident within said computer-based device for facial recognition, which includes Principal Component Analysis, Neural Networks, or another equivalent algorithm for comparing said first human or human-like facial images with said second human or human-like facial image and producing an output signal therefrom for use in identifying said human users. The apparatus can further include software for recognizing speech, generating speech and controlling animation of the articulated toy. In addition, said computer-based device is capable of learning and storing information pertaining to each of said human users such as name, age, sex, favorite color, etc., and to interact with each of said human users on an individual basis, providing entertainment tailored specifically to each of said human users.

15 Claims, 6 Drawing Sheets

U.S. PATENT DOCUMENTS

| | | | | |
|---|---|---|---|---|
| 4,868,877 | A | | 9/1989 | Fischer |
| 4,889,027 | A | | 12/1989 | Yokoi |
| 4,904,851 | A | | 2/1990 | Yukino |
| 4,972,476 | A | | 11/1990 | Nathans |
| 4,975,969 | A | | 12/1990 | Tal |
| 4,980,567 | A | | 12/1990 | Yasuda et al. |
| 4,991,205 | A | | 2/1991 | Lemelson |
| 4,993,068 | A | | 2/1991 | Piosenka et al. |
| 4,995,086 | A | | 2/1991 | Lilley et al. |
| 4,998,279 | A | | 3/1991 | Weiss |
| 5,031,228 | A | | 7/1991 | Lu |
| 5,053,608 | A | | 10/1991 | Senanayake |
| 5,055,658 | A | | 10/1991 | Cockburn |
| 5,063,603 | A | | 11/1991 | Burt |
| 5,074,821 | A | | 12/1991 | McKeefery et al. |
| 5,164,992 | A | | 11/1992 | Turk et al. |
| 5,215,493 | A | | 6/1993 | Zgrodek et al. |
| 5,281,143 | A | | 1/1994 | Arad et al. |
| 5,292,276 | A | | 3/1994 | Manalo |
| 5,314,192 | A | | 5/1994 | Broudy et al. |
| 5,314,336 | A | | 5/1994 | Diamond et al. |
| 5,342,234 | A | | 8/1994 | Bloom |
| 5,372,511 | A | | 12/1994 | Keung |
| 5,376,038 | A | | 12/1994 | Arad et al. |
| 5,386,103 | A | | 1/1995 | DeBan et al. |
| 5,413,516 | A | | 5/1995 | Lam |
| 5,432,864 | A | | 7/1995 | Lu et al. |
| 5,478,240 | A | | 12/1995 | Cogliano |
| 5,562,453 | A | | 10/1996 | Wen |
| 5,653,594 | A | | 8/1997 | Lai |
| 5,656,907 | A | | 8/1997 | Chainani et al. |
| D384,698 | S | | 10/1997 | Chan |
| 5,683,252 | A | | 11/1997 | Tsao |
| D387,383 | S | | 12/1997 | Chan |
| 5,697,829 | A | | 12/1997 | Chainani et al. |
| D392,321 | S | | 3/1998 | Chan |
| 5,724,074 | A | | 3/1998 | Chainani et al. |
| 5,802,220 | A | * | 9/1998 | Black et al. ..... 382/276 |
| 6,064,753 | A | | 5/2000 | Bolle et al. |
| 6,100,811 | A | | 8/2000 | Hsu et al. |
| 6,160,540 | A | | 12/2000 | Fishkin et al. |
| 6,175,772 | B1 | * | 1/2001 | Kamiya et al. ..... 700/31 |
| 6,428,321 | B1 | | 8/2002 | Jurmain et al. |
| 6,445,810 | B1 | | 9/2002 | Darrell et al. |
| 6,807,291 | B1 | * | 10/2004 | Tumey et al. ..... 382/124 |
| 2005/0031172 | A1 | * | 2/2005 | Tumey et al. ..... 382/115 |

FOREIGN PATENT DOCUMENTS

| | | |
|---|---|---|
| GB | 2173970 | 10/1986 |
| WO | WO 92/020000 | 2/1992 |

OTHER PUBLICATIONS

Lippman, Richard P., "Introduction to Computing with Neural Networks," IEEE ASSP Magazine, Apr. 1987, pp. 4-22.

Kirby et al., "Application of the Karhunen-Loeve Procedure for the Characterization of Human Faces," IEEE Trans. On Pat. Analysis and Mach. Int., Jan. 1990, pp. 103-108.

Shackelton and Welsh, "Classification of Facial Features for Recognition", Proc. 1991 IEEE Computer Society Conf. Comp. Vision and Pat. Rec., Jun. 1991, pp. 573-579.

Sutherland, et al, "Automatic Face Recognition," First Int. Conf. On Intelligent Systems, Aug. 21, pp. 29-34.

Turk et al. "Face Recognition Using Eigenfaces," Proc. 1991 Comp. Soc. Conf. On Computer Vision and Pat. Rec., Jun. 6, 1991, pp. 586-591.

Discover Magazine, "In Your Future Face," Dec. 1995, pp. 79-87.

* cited by examiner

ANIMATED TOY UTILIZING ARTIFICIAL INTELLIGENCE AND FACIAL IMAGE RECOGNITION

RELATED APPLICATIONS

This Application claims the benefit of U.S. Provisional Patent Application Ser. No. 60/116,391 filed Jan. 19, 1999.

FIELD OF THE INVENTION

The present invention relates to interactive toys and other interactive entertainment systems.

BACKGROUND AND SUMMARY OF THE INVENTION

There are a number of articulated and animated toys capable of interacting with human users in a way which appears intelligent such as those which are commercially available under the trademarks Furby® from Tiger Electronics, Ltd., and Barney® from MicroSoft Inc. These toys are capable of understanding speech, speaking in a natural language and demonstrating limited animation such as mouth, eye and ear movements. In addition, prior to the development of these more sophisticated toys, which generally include an embedded microprocessor and computer-based algorithm, other predecessors such as that which is commercially available under the trademark Teddy Ruxpin™ from YES! Entertainment Corporation, are also capable of exhibiting semi-intelligent behavior through speech and animation. Teddy Ruxpin™, and other toys like it, utilize a tape mechanism to provide the sound and animation control. Without exception, to date, a toy has never been developed which is capable of recognizing the human user who is playing with the toy. In addition, a toy has never been developed which is capable of recognizing inanimate objects with human-like faces such as dolls, stuffed animals or other toys.

There exists many methods for creating the semblance of intelligence in a toy or video game. Toys with animated moving parts are commonplace and anyone of ordinary skill in the art will be familiar with several methods to fabricate quasi-intelligent articulated toys. Similarly there exists many methods for the biometric identification of humans which includes fingerprint pattern matching, voice recognition, iris scanning, retina imaging as well as facial image recognition.

Fingerprint, iris and retina identification systems are considered "invasive", expensive and not practical for applications where limited computer memory storage is available. Voice recognition, which is not the same as speech recognition, is somewhat less invasive, however it is cost prohibitive and can require excessive memory storage space for the various voice "templates". In addition, identification processing delays can be excessive and unacceptable for many applications.

Face recognition is known and is perhaps the least invasive way to identify a human user. Another known advantage of a face recognition and identification system is that it can be constructed in such a way that its operation is transparent to the user. The prior art references are replete with biometric verification systems that have attempted to identify an individual based on a whole or partial digitized facial image. A major problem that has been recognized implicitly or explicitly by many prior reference inventors is that of securing adequate memory capacity for storing an encoded representation of a person's face on a medium that is compact and inexpensive. Because of this and other limitations, none of the prior references provides suitable means for use in articulated and animated toys. Notable among the prior reference patents pertaining to facial image recognition:

U.S. Pat. No. 3,805,238, wherein Rothfjell teaches an identification system in which major features (e.g. the shape of a person's nose in profile) are extracted from an image and stored. The stored features are subsequently retrieved and overlaid on a current image of the person to verify identity.

U.S. Pat. No. 4,712,103, wherein Gotanda teaches, inter alia, storing a digitized facial image in a non-volatile ROM on a key, and retrieving that image for comparison with a current image of the person at the time he/she request access to a secured area. Gotanda describes the use of image compression, by as much as a factor of four, to reduce the amount of data storage capacity needed by the ROM that is located on the key.

U.S. Pat. No. 4,858,000 wherein Lu teaches an image recognition system and method for identifying ones of a predetermined set of individuals, each of whom has a digital representation of his or her face stored in a defined memory space.

U.S. Pat. No. 4,975,969, wherein Tal teaches an image recognition system and method in which ratios of facial parameters (which Tal defines a distances between definable points on facial features such as a nose, mouth, eyebrow etc.) are measured from a facial image and are used to characterize the individual. Tal, like Lu in U.S. Pat. No. 4,858,000, uses a binary image to find facial features.

U.S. Pat. No. 5,031,228, wherein Lu teaches an image recognition system and method for identifying ones of a predetermined set of individuals, each of whom has a digital representation of his or her face stored in a defined memory space. Face identification data for each of the predetermined individuals are also stored in a Universal Face Model block that includes all the individual pattern images or face signatures stored within the individual face library.

U.S. Pat. No. 5,053,603, wherein Burt teaches an image recognition system using differences in facial features to distinguish one individual from another. Burt's system uniquely identifies individuals whose facial images and selected facial feature images have been learned by the system. Burt's system also "generically recognizes" humans and thus distinguishes between unknown humans and non-human objects by using a generic body shape template.

U.S. Pat. No. 5,164,992 wherein Turk and Pentland teach the use of an Eigenface methodology for recognizing and identifying members of a television viewing audience. The Turk et al system is designed to observe a group of people and identify each of the persons in the group to enable demographics to be incorporated in television ratings determinations.

U.S. Pat. No. 5,386,103, wherein Deban et al teach the use of an Eigenface methodology for encoding a reference face and storing said reference face on a card or the like, then retrieving said reference face and reconstructing it or automatically verifying it by comparing it to a second face acquired at the point of verification. Deban et al teach the use of this system in providing security for Automatic Teller Machine (ATM) transactions, check cashing, credit card security and secure facility access.

U.S. Pat. No. 5,432,864, wherein Lu et al teach the use of an Eigenface methodology for encoding a human facial image and storing it on an "escort memory" for later retrieval or automatic verification. Lu et al teach a method and apparatus for employing human facial image verification for financial transactions.

Although many inventors have offered approaches to providing an encoded facial image that could be stored, retrieved and compared, automatically or manually, at some later time for recognizing said human user, none have succeeded in producing a system that would be viable for use in an articulated and animated toy or video game. Part of the reason for this lies in the severe constraints imposed on the image storage aspect of a system by commercially available microprocessors. Another reason is that the complexity of the algorithms and the hardware necessary to implement them makes such a recognition system cost prohibitive for use with a toy.

SUMMARY OF THE INVENTION

It is an object of the present invention to overcome the problems, obstacles and deficiencies of the prior art.

It is also an object of the present invention to provide an improved apparatus and method for recognizing faces of human users and other inanimate objects such as dolls, stuffed animals or other toys with human-like facial features for use with entertainment systems. It is a more particular object to provide such apparatus and method for use particularly with articulated and animated toys or video games.

It is another object of the present invention to improve the apparatus and method for creating the semblance of intelligence in an articulated and animated toy or video game.

The various aspects of the present invention address these and other objects in many respects, such as by providing an interactive entertainment apparatus that acquires representations of facial characteristics of an animate or inanimate object in its proximity and then produces a signal relative to the acquired representation. In another respect, the invention may provide such an interactive entertainment apparatus which responds to other types of biometric characteristics of a person in its proximity, such as fingerprint characteristics or some other type of biometric characteristic. The interactive entertainment apparatus is preferably embodied as a toy or a video game, although many other types of entertainment apparatus would also be suitable. An appropriate toy might well be embodied in the form of a teddy bear or some other form of doll.

The acquisition of the representation of the facial characteristics is preferably performed by an acquisition device associated with the entertainment device. One adaptation of the acquisition device includes a camera and digitizer for acquiring a light image of the facial characteristics and then translating the image into digital form. Other forms of acquisition devices might include tactile sensors, microphones, thermal sensors, fingerprint readers or any other form of biometric acquisition device.

A processor or CPU is preferably associated with the acquisition device to receive the acquired representations. The processor is preferably adapted to manipulate signals in order to evaluate the acquired representations, make determinations of recognition when appropriate, and produce any desired output relative to the acquired representation and/or the determinations of recognition (or lack thereof).

The processor may be adapted with software or the like which renders a toy capable of recognizing inanimate objects with human-like faces such as dolls, stuffed animals or other toys. Such capability increases the sophistication and intelligence of the toy to levels heretofore unseen. Such a toy may also be adapted to recognize its human user, to learn specific information about the human user, and to interact individually with a number of different users. The invention can provide an entertainment system which tailors the entertainment such that different forms of entertainment are provided to different users. In addition, toys or video games of the invention can be capable of recognizing the facial expression of an individual human user and can tailor their responses to said human user in real-time thus maximizing the challenge and entertainment value of said toy or video game.

The invention has many aspects but is generally directed to method and apparatus for integrating a video camera and computer-based algorithm with an articulated and animated toy capable of recognizing the face of a human user or inanimate object such as a doll or stuffed animal with human-like facial features, and providing entertainment and interaction with said human user in response thereto. In addition, said computer-based toy can learn and store in resident memory, specific information about said human user or inanimate object and further access and recall said information for use in interacting with said human user, such as integrating personal information about said user into a story, after said user is identified. The present invention also relates to integrating video and computer-based algorithms capable of identifying characteristic facial expressions such as happy or sad faces, and providing information therefrom to any computer-based toy or video game whereupon the toy or video game's response is varied in accordance with the type of expression observed.

The algorithms of the present invention have been optimized to run quickly on small inexpensive single board computers and embedded microprocessors. Another unique feature of the present invention that helps to overcome the storage limitations is the automatic removal of facial images that are no longer utilized by the system for recognition of the human user.

One embodiment of the present invention is directed to an apparatus for an articulated and animated toy capable of recognizing human users and selected inanimate objects with human-like facial features and interacting therewith which includes a computer-based device having stored thereon encoded first human or human-like facial images, a video camera and video digitizer for acquiring data representative of a second human or human-like facial image, and software resident within said computer-based device for facial recognition, which includes Principal Component Analysis or Neural Networks, for comparing said first human or human-like facial images with said second human or human-like facial image and producing an output signal therefrom for use in identifying said human users. The apparatus can further include software for recognizing speech, generating speech and controlling animation of the articulated toy. In addition, said computer-based device is capable of learning and storing information pertaining to each of said human users such as name, age, sex, favorite color, etc., and to interact with each of said human users on an individual basis, providing entertainment tailored specifically to each of said human users.

Another embodiment is directed to a method and apparatus for recognizing the facial expression of a human user, and further providing signals thereupon to a computer-controlled device such as a toy or video game. The apparatus includes a computer-based device, video camera and video digitizer for acquiring facial images, and software resident within said computer-based device for facial recognition. The method includes the steps of acquiring a first set of data representative of human facial expressions and storing said expressions in said computer-based device, and acquiring a second set of data representative of human facial expressions and comparing said first and second set of data representative of human expressions utilizing Principal Component Analysis or Neural Networks, and producing an output signal therefrom for use in maximizing the challenge and entertainment value of said toy or video game.

Many other objects, features and advantages will be readily apparent to those of ordinary skill in the art upon viewing the drawings and reading the detailed description hereafter.

DETAILED DESCRIPTION OF THE PREFERRED EMBODIMENT

Figure 1:
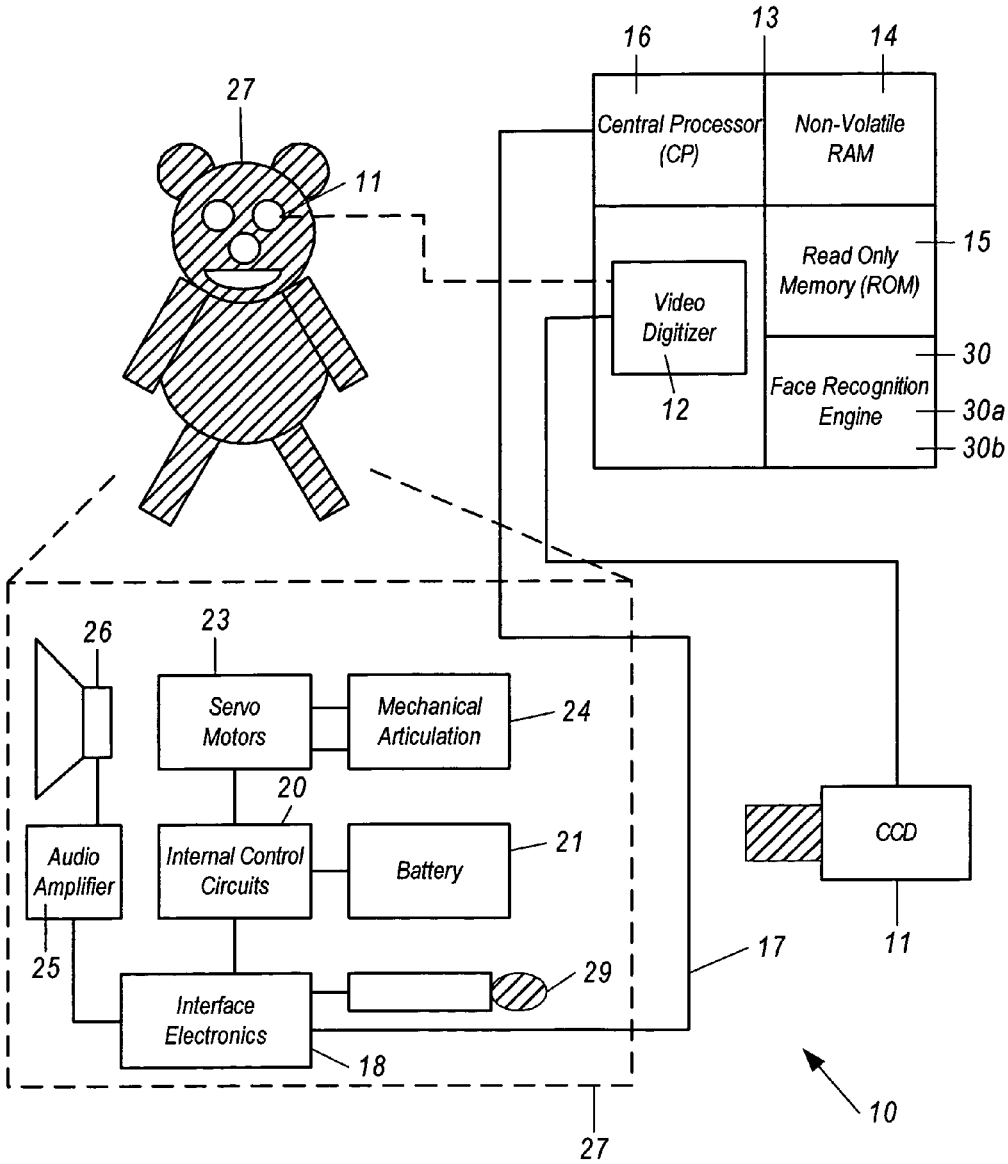
FIG. 1 shows a block diagram of one aspect of the present invention.

Referring to the drawings, an apparatus for an articulated and animated toy capable of recognizing human users 40 and selected inanimate objects and interacting therewith of the present invention is generally referred to by the numeral 10. Referring to FIG. 1, the apparatus 10 includes a computer 13 having a central processor (CP) 16 such as those which are commercially available under the trademarks Intel® 486 or Pentium®, conventional non-volatile Random Access Memory (RAM) 14 and conventional Read Only Memory (ROM) 15. Computer 13 can be of a standard PC configuration such as those which are commercially available under the trademarks Compaq® or Dell®, or can be miniaturized and embedded directly in the toy 27 itself. Computer 13 is further operably associated with a video digitizer 12 and video camera 11. The video camera 11, mounted inside the toy 27, such as a teddy bear, doll or robot, can be a standard inexpensive Charge Coupled Device (CCD) camera, and the video digitizer 12 can be one of many off-the-shelf units commonly employed in personal computers for the acquisition of live video images such as those which are commercially available under the trademarks SNAPPY™, Philips Easy-Video™, WINNOV VideumCam™ or the Matrox Meteor™. The computer 13 has operably associated therewith a face recognition engine 30 which can be one of a Neural Network 30*a* or Principal Component Analysis (PCA) 30*b* or equivalent software engine, the particulars of which are further described hereinafter.

A communications cable 17 is likewise associated with the computer 13 and operably connected to interface electronics 18 for providing speech and articulation control signals to interface electronics 18. If computer 13 is configured as a standard PC, the communications cable 17 will be external, while if computer 13 is embedded directly in the toy, the communications cable 17 will be internal.

Interface electronics 18 is operably connected to the toy's 27 internal control circuits 20. The control circuit 20 is of a standard type such as that employed by Tiger Electronic's Furby® and controls the basic functions of the toy's 27 articulation, including the animation thereof. Control circuit 20 is operably connected to a battery 21 and electronic servo motors 23. Servo motors 23 are flexibly coupled to mechanical articulating means 24. Servo motors 23 are arranged in such a way as to cause animation of various features of the toy 27 such as mouth, eye and ear movements.

In addition to the control functions, audio amplifier 25 speaker 26, and microphone 29 are also operatively connected to interface electronics 18 which allow the toy 27 to recognize speech, and speak to the human user as part of its interaction protocol.

Figure 2:
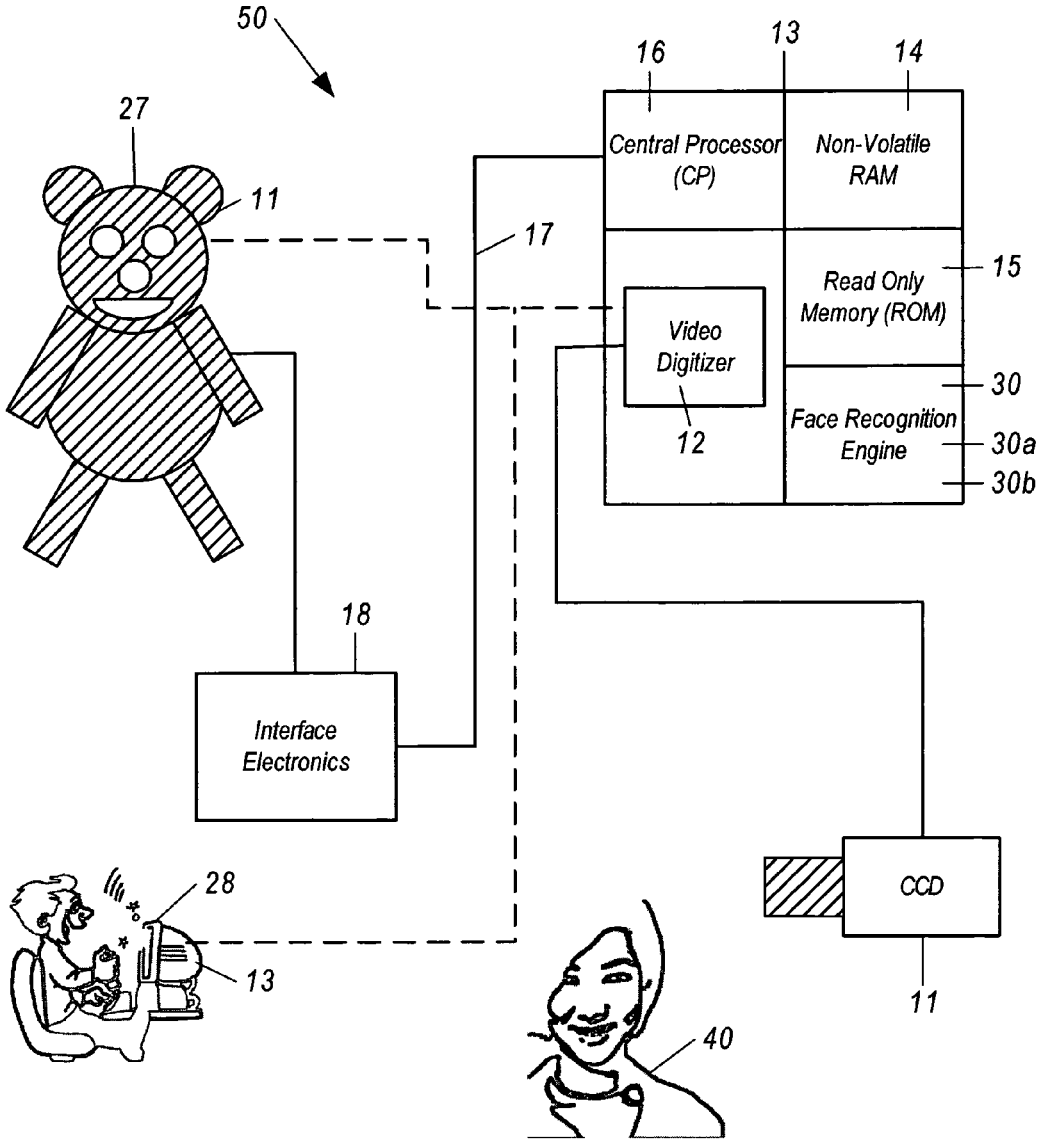
FIG. 2 shows a block diagram of another aspect of the present invention.

Referring now to FIG. 2, an apparatus for recognizing the facial expression of a human user 40, and further providing signals thereupon to a computer-based device such as a toy 27, as described in detail above, or video game 28, is generally referred to by the numeral 50, includes a computer 13 having a central processor (CP) 16 such as those which are commercially available under the trademarks Intel® 486 or Pentium®, conventional non-volatile Random Access Memory (RAM) 14 and conventional Read Only Memory (ROM) 15. Computer 13 can be of a standard PC configuration such as those which are commercially available under the trademarks Compaq® or Dell®, or can be miniaturized and embedded directly in the toy 27 or video game 28 itself. Computer 13 is operably associated with a video digitizer 12 and video camera 11. The video camera 11, mounted inside the toy 27 or video game 28, can be a standard inexpensive Charge Coupled Device (CCD) camera, and the video digitizer 12 can be one of many off-the-shelf units commonly employed in personal computers for the acquisition of live video images such as those which are commercially available under the trademarks SNAPPY™, Philips Easy-Video™, WINNOV VideumCaM™ or the Matrox Meteor™. The computer 13 has operably associated therewith a face recognition engine 30 which can be one of a Neural Network 30*a* or Principal Component Analysis (PCA) 30*b* or equivalent software engine, the particulars of which are further described hereinafter.

A communications cable 17 is likewise operably associated with the computer 13 and operably connected to interface electronics 18 for providing a recognition output signal to interface electronics 18.

Interface electronics 18 is operably connected to the toy 27 or video game 28 and actuated thereupon by a facial image/expression recognition signal from the computer 13. The toy 27 or video game 28 can thus modulate its response to the recognized facial image/expression and maximize the challenge and entertainment value of the toy 27 or video game 28.

Both the articulated and animated toy apparatus 10, and the toy or video game apparatus 50 can make use of a neural network 30*a* or PCA 30*b* facial image recognition engine to generate an output signal indicative of recognition or non-recognition of a human user 40.

There are a variety of methods by which the recognition and identification element of the present invention can be implemented. Although the methods differ in computational structure, it is widely accepted by those of ordinary skill in the art that they are functionally equivalent. An example of two practical techniques, neural network 30*a* and PCA 30*b*, are provided herein below and are depicted in FIG. 3 and FIG. 4 respectively.

Figure 3:
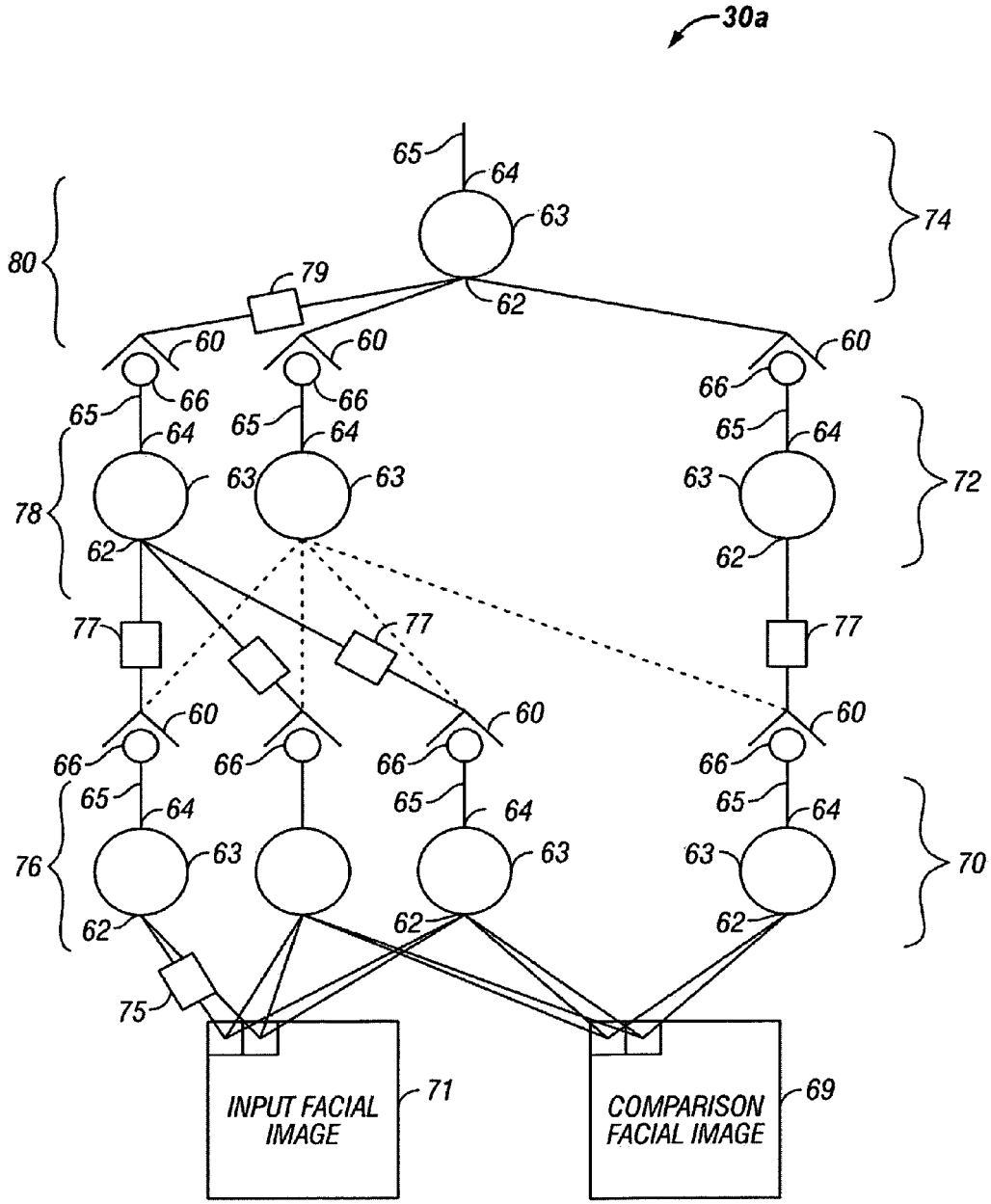
FIG. 3 shows a representation of a neural network of the present invention.
Figure 4:
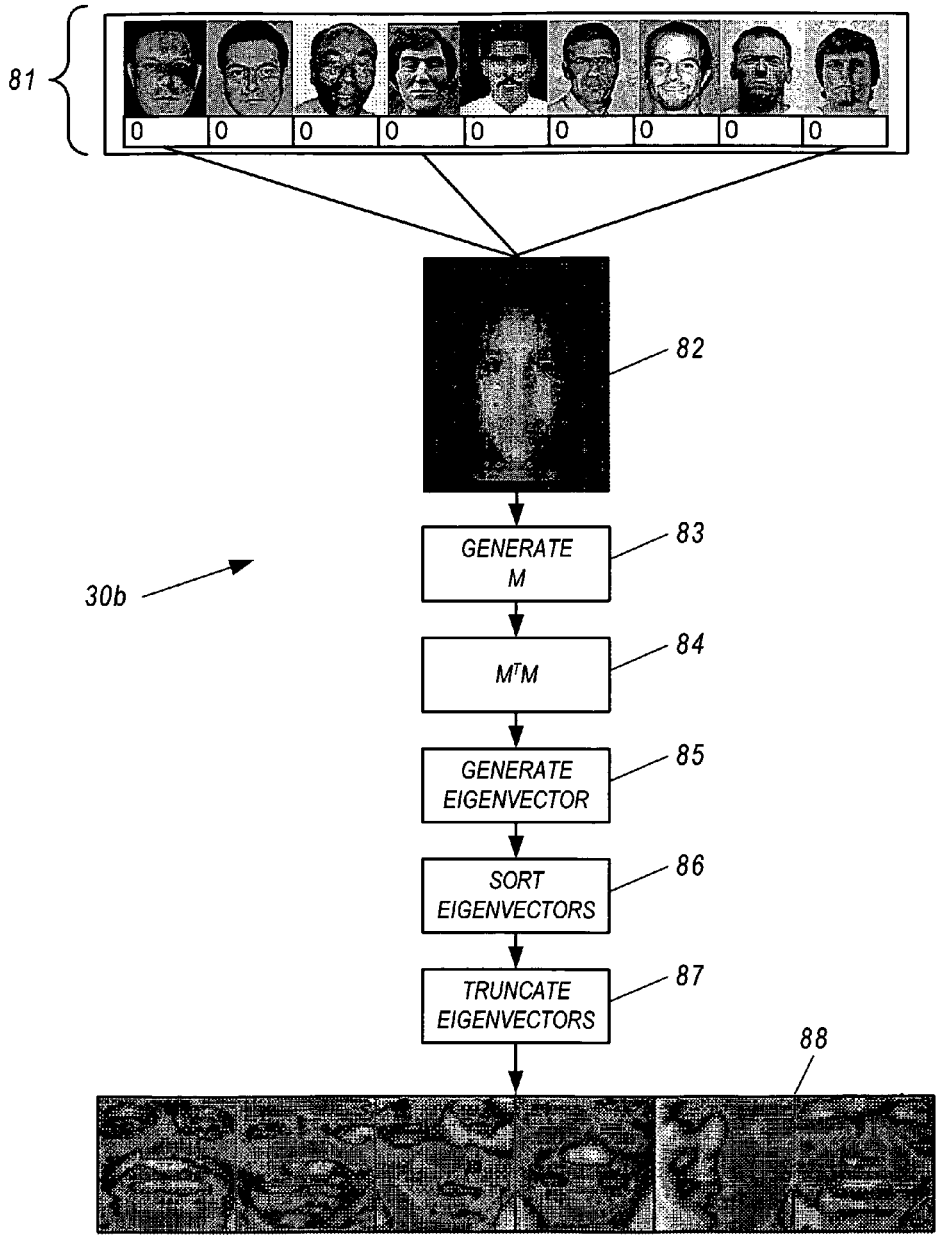
FIG. 4 shows a representation of a Principal Component Analysis (PCA) of the present invention.

As shown in FIG. 3, the neural network 30*a* includes at least one layer of trained neuron-like units, and preferably at least three layers. The neural network 30*a* includes input layer 70, hidden layer 72, and output layer 74. Each of the input layer 70, hidden layer 72, and output layer 74 include a plurality of trained neuron-like units 76, 78 and 80, respectively.

Neuron-like units 76 can be in the form of software or hardware. The neuron-like units 76 of the input layer 70 include a receiving channel for receiving human or human-like facial image data 71, and comparison facial image data 69 wherein the receiving channel includes a predetermined modulator 75 for modulating the signal.

The neuron-like units 78 of the hidden layer 72 are individually receptively connected to each of the units 76 of the input layer 70. Each connection includes a predetermined modulator 77 for modulating each connection between the input layer 70 and the hidden layer 72.

The neuron-like units 80 of the output layer 74 are individually receptively connected to each of the units 78 of the hidden layer 72. Each connection includes a predetermined modulator 79 for modulating each connection between the hidden layer 72 and the output layer 74. Each unit 80 of said output layer 74 includes an outgoing channel for transmitting the output signal.

Each neuron-like unit 76, 78, 80 includes a dendrite-like unit 60, and preferably several, for receiving incoming signals. Each dendrite-like unit 60 includes a particular modulator 75, 77, 79 which modulates the amount of weight which is to be given to the particular characteristic sensed as described below. In the dendrite-like unit 60, the modulator 75, 77, 79 modulates the incoming signal and subsequently transmits a modified signal 62. For software, the dendrite-like unit 60 comprises an input variable $X_a$ and a weight value $W_a$ wherein the connection strength is modified by multiplying the variables together. For hardware, the dendrite-like unit 60 can be a wire, optical or electrical transducer having a chemically, optically or electrically modified resistor therein.

Each neuron-like unit 76, 78, 80 includes a soma-like unit 63 which has a threshold barrier defined therein for the particular characteristic sensed. When the soma-like unit 63 receives the modified signal 62, this signal must overcome the threshold barrier whereupon a resulting signal is formed. The soma-like unit 63 combines all resulting signals 62 and equates the combination to an output signal 64 indicative of one of a recognition or non-recognition of a human or human-like facial image or human facial expression.

For software, the soma-like unit 63 is represented by the sum $\alpha=\Sigma_a X_a W_a-\beta$, where $\beta$ is the threshold barrier. This sum is employed in a Nonlinear Transfer Function (NTF) as defined below. For hardware, the soma-like unit 63 includes a wire having a resistor; the wires terminating in a common point which feeds into an operational amplifier having a nonlinear component which can be a semiconductor, diode, or transistor.

The neuron-like unit 76, 78, 80 includes an axon-like unit 65 through which the output signal travels, and also includes at least one bouton-like unit 66, and preferably several, which receive the output signal from the axon-like unit 65. Bouton/dendrite linkages connect the input layer 70 to the hidden layer 72 and the hidden layer 72 to the output layer 74. For software, the axon-like unit 65 is a variable which is set equal to the value obtained through the NTF and the bouton-like unit 66 is a function which assigns such value to a dendrite-like unit 60 of the adjacent layer. For hardware, the axon-like unit 65 and bouton-like unit 66 can be a wire, an optical or electrical transmitter.

The modulators 75, 77, 79 which interconnect each of the layers of neurons 70, 72, 74 to their respective inputs determines the classification paradigm to be employed by the neural network 30*a*. Human or human-like facial image data 71, and comparison facial image data 69 are provided as inputs to the neural network and the neural network then compares and generates an output signal in response thereto which is one of recognition or non-recognition of the human or human-like facial image or human facial expression.

It is not exactly understood what weight is to be given to characteristics which are modified by the modulators of the neural network, as these modulators are derived through a training process defined below.

The training process is the initial process which the neural network must undergo in order to obtain and assign appropriate weight values for each modulator. Initially, the modulators 75, 77, 79 and the threshold barrier are assigned small random non-zero values. The modulators can each be assigned the same value but the neural network's learning rate is best maximized if random values are chosen. Human or human-like facial image data 71 and comparison facial image data 69 are fed in parallel into the dendrite-like units of the input layer (one dendrite connecting to each pixel in facial image data 71 and 69) and the output observed.

The Nonlinear Transfer Function (NTF) employs $\alpha$ in the following equation to arrive at the output:

$$NTF=1/[1+e^{-\alpha}]$$

For example, in order to determine the amount weight to be given to each modulator for any given human or human-like facial image, the NTF is employed as follows:

If the NTF approaches 1, the soma-like unit produces an output signal indicating recognition. If the NTF approaches 0, the soma-like unit produces an output signal indicating non-recognition.

If the output signal clearly conflicts with the known empirical output signal, an error occurs. The weight values of each modulator are adjusted using the following formulas so that the input data produces the desired empirical output signal.

For the output layer:

$$W^*_{kol}=W_{kol}+GE_kZ_{kos}$$

$W^*_{kol}$=new weight value for neuron-like unit k of the outer layer.

$W_{kol}$=current weight value for neuron-like unit k of the outer layer.

G=gain factor $Z_{kos}$=actual output signal of neuron-like unit k of output layer.

$D_{kos}$=desired output signal of neuron-like unit k of output layer.

$E_k=Z_{kos}(1-Z_{kos})(D_{kos}-Z_{kos})$, (this is an error term corresponding to neuron-like unit k of outer layer).

For the hidden layer:

$$W^*_{jhl}=W_{jhl}+GE_jY_{jos}$$

$W^*_{jhl}$=new weight value for neuron-like unit j of the hidden layer.

$W_{jhl}$=current weight value for neuron-like unit j of the hidden layer.

G=gain factor $Y_{jos}$=actual output signal of neuron-like unit j of hidden layer.

$E_j = Y_{jos}(1-Y_{jos})\ \Sigma_k\ (E_k * W_{kol})$, (this is an error term corresponding to neuron-like unit j of hidden layer over all k units).

For the input layer:

$$W^*_{iil} = W_{iil} + GE_i X_{ios}$$

$W^*_{iil}$=new weight value for neuron-like unit I of input layer.

$W_{iil}$=current weight value for neuron-like unit I of input layer.

G=gain factor $X_{ios}$=actual output signal of neuron-like unit I of input layer.

$E_i = X_{ios}(1-X_{ios})\ \Sigma_j\ (E_j * W_{jhl})$, (this is an error term corresponding to neuron-like unit i of input layer over all j units).

The training process consists of entering new (or the same) exemplar data into neural network 30*a* and observing the output signal with respect to known empirical output signal. If the output is in error with what the known empirical output signal should be, the weights are adjusted in the manner described above. This iterative process is repeated until the output signals are substantially in accordance with the desired (empirical) output signal, then the weight of the modulators are fixed.

Upon fixing the weights of the modulators, predetermined face-space memory indicative of recognition and non-recognition are established. The neural network is then trained and can make generalizations about human or human-like facial image input data by projecting said input data into face-space memory which most closely corresponds to that data.

The description provided for neural network 30*a* as utilized in the present invention is but one technique by which a neural network algorithm can be employed. It will be readily apparent to those who are of ordinary skill in the art that numerous neural network model types including multiple (sub-optimized) networks as well as numerous training techniques can be employed to obtain equivalent results to the method as described herein above.

Referring now particularly to FIG. 4, and according to a second preferred embodiment of the present invention, a principal component analysis (PCA) may be implemented as the system's face recognition engine 30. The PCA facial image recognition/verification engine generally referred to by the numeral 30*b*, includes a set of training images 81 which consists of a plurality of digitized human or human-like facial image data 71 representative of a cross section of the population of human faces. In order to utilize PCA in facial image recognition/verification a Karhunen-Loeve Transform (KLT), readily known to those of ordinary skill in the art, can be employed to transform the set of training images 81 into an orthogonal set of basis vectors or eigenvectors. In the present invention, a subset of these eigenvectors, called eigenfaces, comprise an orthogonal coordinate system, detailed further herein, and referred to as face-space.

The implementation of the KLT is as follows: An average facial image 82, representative of an average combination of each of the training images 81 is first generated. Next, each of the training images 81 are subtracted from the average face 82 and arranged in a two dimensional matrix 83 wherein one dimension is representative of each pixel in the training images, and the other dimension is representative of each of the individual training images. Next, the transposition of matrix 83 is multiplied by matrix 83 generating a new matrix 84. Eigenvalues and eigenvectors 85 are thenceforth calculated from the new matrix 84 using any number of standard mathematical techniques that will be well known by those of ordinary skill in the art. Next, the eigenvalues and eigenvectors 85 are sorted 86 from largest to smallest whereupon the set is truncated to only the first several eigenvectors 87 (e.g. between 5 and 20 for acceptable performance). Lastly, the truncated eigenvalues and eigenvectors 87 are provided as outputs 88. The eigenvalues and eigenvectors 88 and average face 82 can then be stored inside the ROM memory 14 in the computer 13 for use in recognizing or verifying facial images.

Figure 5:
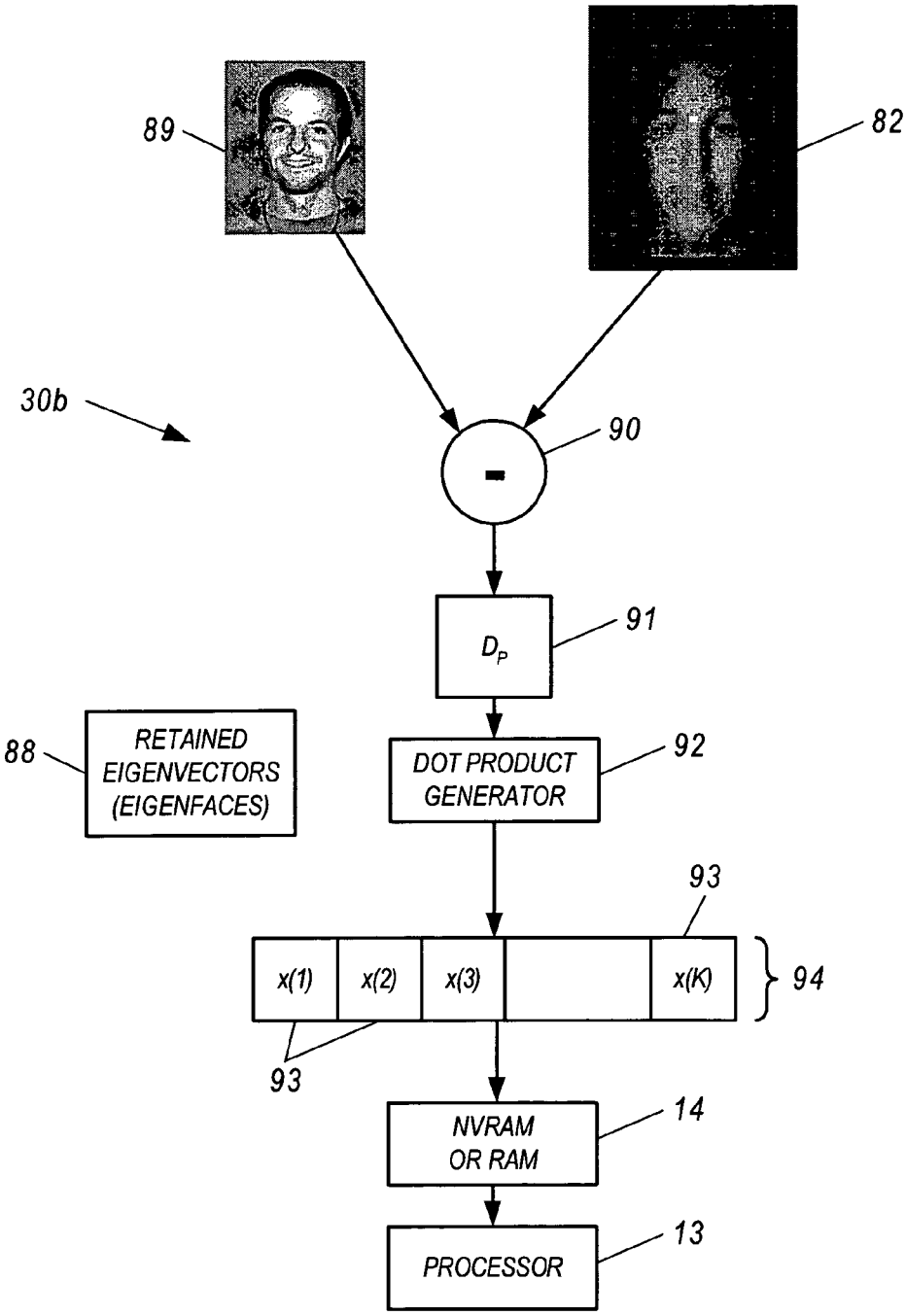
FIG. 5 shows a representation of a human or human-like facial image transformation of the present invention.

Referring now to FIG. 5, for the PCA algorithm 30*b* facial image recognition/identification is accomplished by first finding and converting a human or human-like facial image to a small series of coefficients which represent coordinates in a face-space that are defined by the orthogonal eigenvectors 88. First a preprocessing step, defined further herein below, is employed to locate, align and condition the digital video images. Facial images are then projected as a point in face-space. Verification of a human user 40 is provided by measuring the euclidean distance between two such points in face-space. Thus, if the coefficients generated as further described below represent points in face-space that are within a predetermined acceptance distance, a signal indicative of recognition is generated. If, on the other hand, the two points are far apart, a signal indicative on non-recognition is generated. Although this method is given as a specific example of how the PCA 30*b* algorithm works, the mathematical description and function of the algorithm is equivalent to that of the neural network 30*a* algorithm. The projection of the faces into face-space is accomplished by the individual neurons and hence the above description accurately relates an analogous way of describing the operation of neural network 30*a*.

Again using the PCA 30*b* algorithm as an example, a set of coefficients for any given human or human-like facial image is produced by taking the digitized human or human-like facial image 89 of a human user 40 and subtracting 90 the average face 82. Next, the dot product 91 between the difference image and one eigenvector 88 is computed by dot product generator 92. The result of the dot product with a single eigenface is a numerical value 93 representative of a single coefficient for the image 89. This process is repeated for each of the set of eigenvectors 88 producing a corresponding set of coefficients 94 which can then be stored in the non-volatile RAM memory 14 operably associated with computer 13 described herein above.

As further described below, said first human or human-like facial images of a human user 40 are stored in non-volatile RAM memory 14 during the training process. Each time the facial image of human user 40 is acquired by the video camera 11 thereafter, a said second human or human-like facial image of said human user 40 is acquired, the facial image is located, aligned, processed and compared to said first human or human-like facial image by PCA 30*b* or neural network 30*a*. Thus, the technique as described above provides the means by which two said facial image sets can be accurately compared and a recognition signal can be generated therefrom. For facial expression recognition, individual facial images of human user 40 representative of each of said facial expressions is acquired and stored for later comparison.

The preferred method of acquiring and storing the aforesaid facial images/expressions of said human user 40, begins with the human user 40, providing multiple facial images of him/herself to be utilized as templates for all subsequent recognition and identification. To accomplish this, the human user 40 instructs computer 13 to enter a "learning"

mode whereupon computer 13 gathers specific information about the human user 40 such as name, age, favorite color, etc. and prepares to gather facial images/expressions of human user 40. The computer 13 acquires several digitized first human or human-like facial images of the human user 40 through the use of CCD video camera 11 and digitizer 12. These first human or human-like facial images are preprocessed, the highest quality images selected and thenceforth encoded and stored in the non-volatile RAM memory 14 of computer 13. These remaining fist human or human-like facial images will be utilized thereafter as the reference faces. When a human user 40 interacts with the toy 27 or video game 28, the human user 40 trigger's motion detection and face finding algorithms embedded in the facial image recognition software engine 30. At this time, video camera 11 begins acquiring second human or human-like facial images of the human user 40 and converts said second human or human-like facial images to digital data via digitizer 12. The digitized second human or human-like facial images obtained thereafter are stored in the non-volatile memory 14 of computer 13 as comparison faces.

Once the said second human or human-like facial image has been stored in the computer 13, the facial recognition engine 30, either neural network 30*a* or PCA 30*b* can be employed to perform a comparison between said stored first human or human-like facial image and said stored second human or human-like facial image and produce an output signal in response thereto indicative of recognition or non-recognition of the human user 40. The output signal is therewith provided to the interface electronics 18 via communications cable 17. Interface electronics 18 is responsible for interfacing the computer 13 with the toy 27 or video game's 28 onboard control circuit 20 to enable the transfer of signals thereto.

In the event the said second human or human-like facial image or facial expression of human user 40 is recognized, the operational software resident in computer 13 can provide entertaining interaction, including speech and multiple feature animation, with human user 40, and can tailor its responses specifically to human user 40 based on knowledge obtained during the learning and training process. Learning can continue as the user interacts with the toy 27 or video game 28 and is not limited to the information initially collected. In the event the said second human or human-like facial image of human user 40 is not recognized, the operational software resident in computer 13 can interact with the human user 40 in a generic way and can alternatively automatically enter a "learning" mode if the human user expresses a desire to interact with the toy 27 or video game 28 in this fashion.

Figure 6:
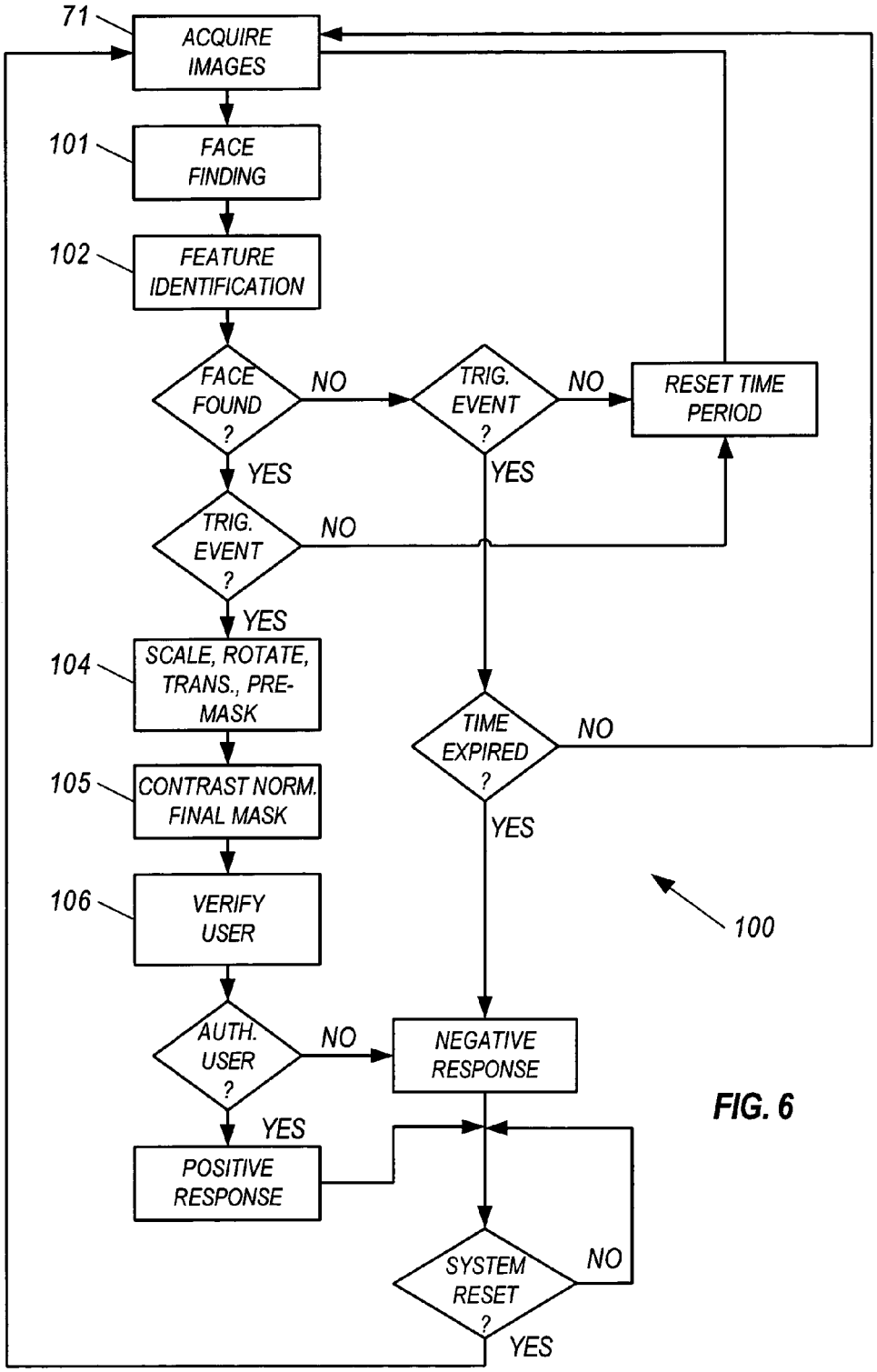
FIG. 6 shows exemplar steps utilized by the face recognition software engine in preprocessing facial image data prior to recognition/identification.

As previously stated and referring now to FIG. 6, a preprocessing function 100 must typically be implemented in order to achieve efficient and accurate processing by the chosen face recognition engine 30 of acquired human or human-like facial image data 71. Whether utilizing a neural network 30*a*, PCA 30*b* or another equivalent face recognition engine, the preprocessing function generally comprises elements adapted for (1) face finding 101, (2) feature extraction 102, (3) determination of the existence within the acquired data of a human or human-like facial image 103, (4) scaling, rotation, translation and pre-masking of the captured human image data 104, and (5) contrast normalization and final masking 105. Although each of these preprocessing function elements 101, 102, 103, 104, 105 is described in detail further herein, those of ordinary skill in the art will recognize that some or all of these elements may be dispensed with depending upon the complexity of the chosen implementation of the face recognition engine 30 and desired overall system attributes.

In the initial preprocessing step of face finding 101, objects exhibiting the general character of a human or human-like facial image are located within the acquired image data 71 where after the general location of any such existing object is tracked. Although those of ordinary skill in the art will recognize equivalent alternatives, three exemplary face finding techniques are (1) baseline subtraction and trajectory tracking, (2) facial template subtraction, or the lowest error method, and (3) facial template cross-correlation.

In baseline subtraction and trajectory tracking, a first, or baseline, acquired image is generally subtracted, pixel value-by-pixel value, from a second, later acquired image. As will be apparent to those of ordinary skill in the art, the resulting difference image will be a zero-value image if there exists no change in the second acquired image with respect to the first acquired image. However, if the second acquired image has changed with respect to the first acquired image, the resulting difference image will contain nonzero values for each pixel location in which change has occurred. Assuming that a human user 40 will generally be non-stationary with respect to the system's camera 11, and will generally exhibit greater movement than any background object, the baseline subtraction technique then tracks the trajectory of the location of a subset of the pixels of the acquired image representative of the greatest changes. During initial preprocessing 101, 102, this trajectory is deemed to be the location of a likely human or human-like facial image.

In facial template subtraction, or the lowest error method, a ubiquitous facial image, i.e. having only nondescript facial features, is used to locate a likely human or human-like facial image within the acquired image data. Although other techniques are available, such a ubiquitous facial image may be generated as a very average facial image by summing a large number of facial images. According to the preferred method, the ubiquitous image is subtracted from every predetermined region of the acquired image, generating a series of difference images. As will be apparent to those of ordinary skill in the art, the lowest error in difference will generally occur when the ubiquitous image is subtracted from a region of acquired image data containing a similarly featured human or human-like facial image. The location of the region exhibiting the lowest error, deemed during initial preprocessing 101, 102 to be the location of a likely human or human-like facial image, may then be tracked.

In facial template cross-correlation, a ubiquitous image is cross-correlated with the acquired image to find the location of a likely human or human-like facial image in the acquired image. As is well known to those of ordinary skill in the art, the cross-correlation function is generally easier to conduct by transforming the images to the frequency domain, multiplying the transformed images, and then taking the inverse transform of the product. A two-dimensional Fast Fourier Transform (2D-FFT), implemented according to any of myriad well known digital signal processing techniques, is therefore utilized in the preferred embodiment to first transform both the ubiquitous image and acquired image to the frequency domain. The transformed images are then multiplied together. Finally, the resulting product image is transformed, with an inverse FFT, back to the time domain as the cross-correlation of the ubiquitous image and acquired image. As is known to those of ordinary skill in the art, an impulsive area, or spike, will appear in the cross-correlation in the area of greatest correspondence between the ubiquitous image and acquired image. This spike, deemed to be the location of a likely human or human-like facial image, is then tracked during initial preprocessing 101, 102.

Once the location of a likely human or human-like facial image is known, feature identification 102 is employed to determine the general characteristics of the thought-to-be human or human-like facial image for making a threshold verification that the acquired image data contains a human or human-like facial image and in preparation for image normalization. Feature identification preferably makes use of eigenfeatures, generated according to the same techniques previously detailed for generating eigenfaces, to locate and identify human or human-like facial features such as the eyes, nose and mouth. The relative locations of these features are then evaluated with respect to empirical knowledge of the human face, allowing determination of the general characteristics of the thought-to-be human or human-like facial image as will be understood further herein. As will be recognized by those of ordinary skill in the art, templates may also be utilized to locate and identify human or human-like facial features according to the time and frequency domain techniques described for face finding 101.

Once the initial preprocessing function elements 101, 102 have been accomplished, the system is then prepared to make an evaluation 103 as to whether there exists a facial image within the acquired data, i.e. whether a human user 40 is within the field of view of the system's camera 11. According to the preferred method, the image data is either accepted or rejected based upon a comparison of the identified feature locations with empirical knowledge of the human face. For example, it is to be generally expected that two eyes will be found generally above a nose, which is generally above a mouth. It is also expected that the distance between the eyes should fall within some range of proportion to the distance between the nose and mouth or eyes and mouth or the like. Thresholds are established within which the location or proportion data must fall in order for the system to accept the acquired image data as containing a human or human-like facial image. If the location and proportion data falls within the thresholds, preprocessing continue. If, however, the data falls without the thresholds, the acquired image is discarded.

Threshold limits may also be established for the size and orientation of the acquired human or human-like facial image in order to discard those images likely to generate erroneous recognition results due to poor presentation of the user 40 to the system's camera 11. Such errors are likely to occur due to excessive permutation, resulting in overall loss of identifying characteristics, of the acquired image in the morphological processing 104, 105 required to normalize the human or human-like facial image data, as detailed further herein. Applicant has found that it is simply better to discard borderline image data and acquire a new better image. For example, the system 10 may determine that the image acquired from a user 40 looking only partially at the camera 11, with head sharply tilted and at a large distance from the camera 11, should be discarded in favor of attempting to acquire a better image, i.e. one which will require less permutation 104, 105 to normalize. Those of ordinary skill in the art will recognize nearly unlimited possibility in establishing the required threshold values and their combination in the decision making process. The final implementation will be largely dependent upon empirical observations and overall system implementation.

Although the threshold determination element 103 is generally required for ensuring the acquisition of a valid human or human-like facial image prior to subsequent preprocessing 104, 105 and eventual attempts by the face recognition engine 30 to verify 106 the recognition status of a user 40, it is noted that the determinations made may also serve to indicate a triggering event condition. As previously stated, one of the possible triggering event conditions associated with the apparatus is the movement of a user 40 within the field of view of the system's camera 11. Accordingly, much computational power may be conserved by determining the existence 103 of a human or human-like facial image as a preprocessing function—continuously conducted as a background process. Once verified as a human or human-like facial image, the location of the image within the field of view of the camera 11 may then be relatively easily monitored by the tracking functions detailed for face finding 101. The system 10 may thus be greatly simplified by making the logical inference that an identified known user 40 who has not moved out of sight, but who has moved, is the same user 40.

After the system 10 determines the existence of human or human-like facial image data, and upon triggering of a recognition event, the human or human-like facial image data is scaled, rotated, translated and pre-masked 104, as necessary. Applicant has found that the various face recognition engines 30 perform with maximum efficiency and accuracy if presented with uniform data sets. Accordingly, the captured image is scaled to present to the face recognition engine 30 a human or human-like facial image of substantially uniform size, largely independent of the user's distance from the camera 11. The captured image is then rotated to present the image in a substantially uniform orientation, largely independent of the user's orientation with respect to the camera 11. Finally, the captured image is translated to position the image preferably into the center of the acquired data set in preparation for masking, as will be detailed further herein. Those of ordinary skill in the art will recognize that scaling, rotation and translation are very common and well-known morphological image processing functions that may be conducted by any number of well known methods. Once the captured image has been scaled, rotated and translated, as necessary, it will reside within a generally known subset of pixels of acquired image data. With this knowledge, the captured image is then readily pre-masked to eliminate the background viewed by the camera 11 in acquiring the human or human-like facial image. With the background eliminated, and the human or human-like facial image normalized, much of the potential error can be eliminated in contrast normalization 105, detailed further herein, and eventual recognition 106 by the face recognition engine 30.

Because it is to be expected that the present invention 10 will be placed into service in widely varying lighting environments, the preferred embodiment includes the provision of a contrast normalization 105 function for eliminating adverse consequences concomitant the expected variances in user illumination. Although those of ordinary skill in the art will recognize many alternatives, the preferred embodiment of the present invention 10 comprises a histogram specification function for contrast normalization. According to this method, a histogram of the intensity and/or color levels associated with each pixel of the image being processed is first generated. The histogram is then transformed, according to methods well known to those of ordinary skill in the art, to occupy a predetermined shape. Finally, the image being processed is recreated with the newly obtained intensity and/or color levels substituted pixel-by-pixel. As will be apparent to those of ordinary skill in the art, such contrast normalization 105 allows the use of a video camera 11 having very wide dynamic range in combination with a video digitizer 12 having very fine precision while arriving at an image to be verified having only a manageable number of possible intensity and/or pixel values. Finally, because the contrast normalization 105 may reintroduce background to the image, it is preferred that a final masking 105 of the image be performed prior to facial image recognition 106. After final masking, the image is ready for recognition 106 as described herein above.

The above described embodiments are set forth by way of example and are not for the purpose of limiting the claims of the present invention. It will be readily apparent to those or ordinary skill in the art that obvious modifications, derivations and variations can be made to the embodiments without departing from the scope of the invention. For example, the facial image recognition engine described above as either a neural network or PCA could also be one of a statistical based system, template or pattern matching, or even rudimentary feature matching whereby the features of the face (e.g. eye, nose and mouth locations) are analyzed. Accordingly, the claims appended hereto should be read in their full scope including any such modifications, derivations and variations.

What is claimed is:

1. An interactive entertainment apparatus operable to biometrically identify an imaged one of a plurality of animate or inanimate objects having facial or face-like characteristics by measuring the facial or face-like characteristics of the imaged object, the interactive entertainment apparatus comprising:

an entertainment device positionable in proximity to said plurality of animate or inanimate objects, the entertainment device being capable of providing entertaining interaction with said plurality of animate or inanimate objects;

an acquisition device associated with said entertainment device, said acquisition device being adapted to acquire a representation of a facial characteristic of an object in proximity to said entertainment device, and said acquisition device being adapted to produce a signal relative to the acquired representation; and a processor associated with said acquisition device in a manner to receive the produced signal from said acquisition device, said processor being adapted to compare the produced signal relative to data stored in memory and to provide an output signal indicative of a facial recognition of a particular one of said animate or inanimate objects;

wherein the entertainment device provides said entertaining interaction in response to said output signal indicative of recognition.

2. The interactive entertainment apparatus of claim 1, wherein said entertainment device comprises a toy.

3. The interactive entertainment apparatus of claim 2, wherein said toy comprises a doll and said acquisition device is mounted to said doll.

4. The interactive entertainment apparatus of claim 2, wherein:

said toy comprises a doll; and said acquisition device includes a camera contained within the head of said doll, said camera being situated to view objects located in front of the face of said doll.

5. The interactive entertainment apparatus of claim 4, wherein:

said processor is mounted inside said doll.

6. The interactive entertainment apparatus of claim 4, wherein:

said doll is a teddy bear; and said camera is mounted within the head of said teddy bear in a position to view objects through the eye of said teddy bear.

7. The interactive entertainment apparatus of claim 1, wherein said entertainment device comprises a video game.

8. The interactive entertainment apparatus of claim 1, wherein:

said acquisition device comprises a camera for acquiring a representation of all objects in proximity to said entertainment device;

said acquisition device is adapted to produce a signal relative to the acquired representation of all objects in proximity to said entertainment device; and said processor is adapted to locate a characteristic portion of said produced signal, the characteristic portion being a portion that corresponds to a facial characteristic of one of the objects in proximity to said entertainment device.

9. The interactive entertainment apparatus of claim 8, wherein:

said processor is further adapted to store representations of produced signals received from said acquisition device; and said processor is adapted to compare a representation of a received signal relative to signal representations previously stored by said processor, to determine whether the received signal corresponds with a previous signal, and, if so, to provide an output signal indicative of recognition.

10. The interactive entertainment apparatus of claim 9, wherein:

said processor utilizes artificial intelligence to compare signal representations and determine whether the received signal corresponds with a previous signal.

11. An interactive entertainment apparatus comprising:

an entertainment device positionable in proximity to a person, the entertainment device capable of providing entertaining interaction with the person;

an acquisition device associated with said entertainment device, said acquisition device being adapted to acquire a representation of a facial characteristic of the person in proximity to said entertainment device, and said acquisition device being adapted to produce a signal relative to the acquired representation; and a processor associated with said acquisition device in a manner to receive the produced signal from said acquisition device, said processor being adapted to compare the produced signal relative to data stored in memory and to provide an output signal indicative of facial recognition of a particular person;

wherein the entertainment device provides said entertaining interaction in response to said output signal indicative of recognition.

12. A toy comprising:

a camera and digitizer for acquiring representations of human facial images;

a CPU associated with said camera and digitizer and capable of manipulating signals therefrom;

a speaker and sound controls whereby sounds produced by said toy may be controlled;

a computer readable medium having instructions for locating and biometrically recognizing said human facial images and providing an output facial image recognition signal indicative of a particular person;

wherein the toy provides entertaining interaction in response to said output facial image recognition signal;

said computer readable medium further having instructions capable of recognizing expressions in said facial images and providing a facial expression recognition signal indicative of recognition of said expressions; and wherein said sound controls are responsive to said facial expression recognition signal to modify the sounds produced by said toy in relation to said facial expression recognition signal.

13. The toy of claim 12, wherein:

said toy further comprises a microphone for the detection of sounds in the proximity of said toy; and said computer readable medium further having instructions adapted to recognize human speech included in sounds detected by said microphone and control the toy in response to recognized human speech.

14. The toy of claim 13, wherein:

said sound controls include software controls included in said software, said software controls being adapted to produce synthesized speech; and said toy further comprises animation controls adapted to control one or more motions of the toy; and said animation controls are responsive to said facial expression recognition signal to animate said toy in relation to said facial expression recognition-signal; and said computer readable medium further having instructions adapted to produce synthesized speech choreographed with mechanical animation in response to recognition of said facial images and in response to recognition of said expressions.

15. The toy of claim 14, wherein said computer readable medium has instructions adapted for sending and receiving E-mail and providing other Internet-related interaction once said facial image is recognized.

* * * * *